United States Patent [19]

Orlov et al.

[11] Patent Number: 5,026,271

[45] Date of Patent: Jun. 25, 1991

[54] LOG OR COAL EFFECT FIRE

[75] Inventors: Alexei D. Orlov, Bucks; Ross O. Nixon; John H. D. Misick, both of London, all of United Kingdom

[73] Assignee: Hunter Douglas International NV, Willemstad, Netherlands

[21] Appl. No.: 551,532

[22] Filed: Jul. 12, 1990

[30] Foreign Application Priority Data

Jul. 20, 1989 [GB] United Kingdom ..... 8916638

[51] Int. Cl.[5] ..... F23Q 2/32

[52] U.S. Cl. ..... 431/125; 126/92 AC; 126/512

[58] Field of Search ..... 431/125; 126/500, 512, 126/92 R, 92 AC

[56] References Cited

U.S. PATENT DOCUMENTS 4,582,478 4/1986 Hilker ..... 431/125

*Primary Examiner*—Carroll B. Dority

*Attorney, Agent, or Firm*—Fleit, Jacobson, Cohn, Price, Holman & Stern

[57] ABSTRACT

A log or coal effect fire in which imitation logs 20–26 are mounted on a frame 10 and are distributed to leave an opening 28. A drawer 30 is slidable forwardly and contains a reservoir 32 for gel fuel. Positioned above the reservoir is an aperture plate 34 having at least one aperture 36 therein and associated with this is a snuffer plate 58 which can be moved forwardly by operation of a control knob 56 progressively to close the aperture 36.

18 Claims, 4 Drawing Sheets

LOG OR COAL EFFECT FIRE

The present invention relates to log or coal effect fires.

There are many forms of such fires which use a number of different fuels including in particular gas and the same effect is often achieved in electric fires. It has recently been proposed to use a semi-solid fuel including a wax or gel, one such gel being disclosed in the U.S. Pat. No. 4,575,379 and including isopropyl, alcohol and cellulose gum and denatured alcohol. This fuel is particularly useful because the products of combustion are not noxious and it is practical to use the fuel where there is no flue. However, the operation and control of known fires (e.g. as shown in U.S. Pat. No. 4,573,905) using such a fuel has not, to date, been fully satisfactory.

It is now proposed, according to the present invention, to provide a log or coal effect fire comprising a frame, imitation logs or coal mounted on or supported by said frame, a drawer slidable or pivotable with respect to said frame from a first, operational position in which it is located below said imitation logs or coal, to a second, access position in which access can be gained to the interior of the drawer, an open topped fuel container for a gel or wax fuel mounted or mountable in the drawer at a location below the imitation logs or coal and an aperture means, e.g. a plate, having at least one aperture formed therein, said aperture means being positioned to overlie the open topped fuel container.

With such a structure, it is readily possible to operate the fire by introducing the container or reservoir of fuel into the drawer when the drawer has been moved to its access position and the aperture plate provides a controlled burning of the flame which can readily be lit from above via the aperture, or one of the apertures where more than one is provided, and the drawer then closed.

By "open topped fuel container" is meant a container which has one or more openings in its upper surface or a container which has no cover at all. In one particular advantageous construction the aperture means is an aperture plate which includes a single aperture in the form of an elongate slot, the major axis of the slot extending transversely of the fire.

The container may form part of the drawer and is shaped to accommodate one or more separate fuel reservoirs Alternatively the container itself is an interchangeable fuel reservoir.

In order to give a long lasting burning ability, the container needs to be reasonably large and in a preferred construction, the container is substantially rectangular in shape and the elongate slot is shaped to overlie a major part of the open top of the container.

It has been found that a very advantageous burning effect can be achieved if there are four imitation logs mounted on said frame, a first, rear log extending transversely of the fire, a second front log, of smaller cross section than the first log and extending substantially parallel thereto, and third and fourth logs extending in spaced substantially parallel relation to one another, substantially perpendicular to the first and second logs to define a generally rectangular opening therebetween.

The drawer may be movable in a number of different ways. For example it can be slidable or pivotable, but preferably it is movable by forward sliding motion from its operational to its access position.

Preferably regulating means are provided to regulate the size of the or each aperture in the aperture means. Many different forms of regulating means are contemplated. For example the aperture means may itself be moved. Alternatively or additionally snuffer means, e.g. a snuffer plate is associated with said aperture plate and is movable to open and close the or each aperture in the aperture plate. Said direction is preferably linear and in a simple construction the engagement means comprises an abutment.

In order to provide for the accurate control of the flame and in particular to ensure that the flame can be put out, from a safety point of view, the regulation means comprise a snuffer plate associated with said aperture plate and movable progressively to open and close the or each aperture in the aperture plate. The snuffer plate may have a straight or serrated edge; in the latter case the serrations can be used to divide the or each aperture.

The movement of the snuffer plate can again be sliding or pivoting but preferably it is slidable forwardly to close the or each aperture.

In order to control the snuffer means, control means may be connected to said snuffer means to effect the movement thereof, said control means having engagement means engageable with the drawer, whereby, when said control means is operated in one direction, the snuffer means firstly closes the or each aperture in the aperture means and, when the or each aperture is fully closed, further operation in said one direction causes said drawer to move forwardly to its access position.

It will be appreciated that the aperture means, e.g. the aperture plate and the snuffer means, e.g. the snuffer plate normally overlie the reservoir of fuel. Desirably, therefore, said aperture plate and said snuffer plate are movable to a position to enable said fuel reservoir to be readily removed from said drawer and a fresh reservoir inserted.

In order to enable the operation of the fire greatly to be simplified, said aperture means and said snuffer means are interconnected so that by operation of said control means additionally, after having been operated to bring said drawer to its access position, said aperture means and said snuffer means can be moved to a position, to give access to said fuel container or reservoir. In a simplest construction the aperture means and snuffer means are each plates and the aperture plate and the snuffer plate are pivotal together about a transverse, horizontal hinge line, whereby said control rod can be raised, after being pulled fully forwardly, to pivot said plates to a generally vertical position, to give access to said fuel reservoir.

In order that the present invention may more readily understood, the following description is given, merely by way of example, reference being made to the accompanying drawings in which.

Figure 1:
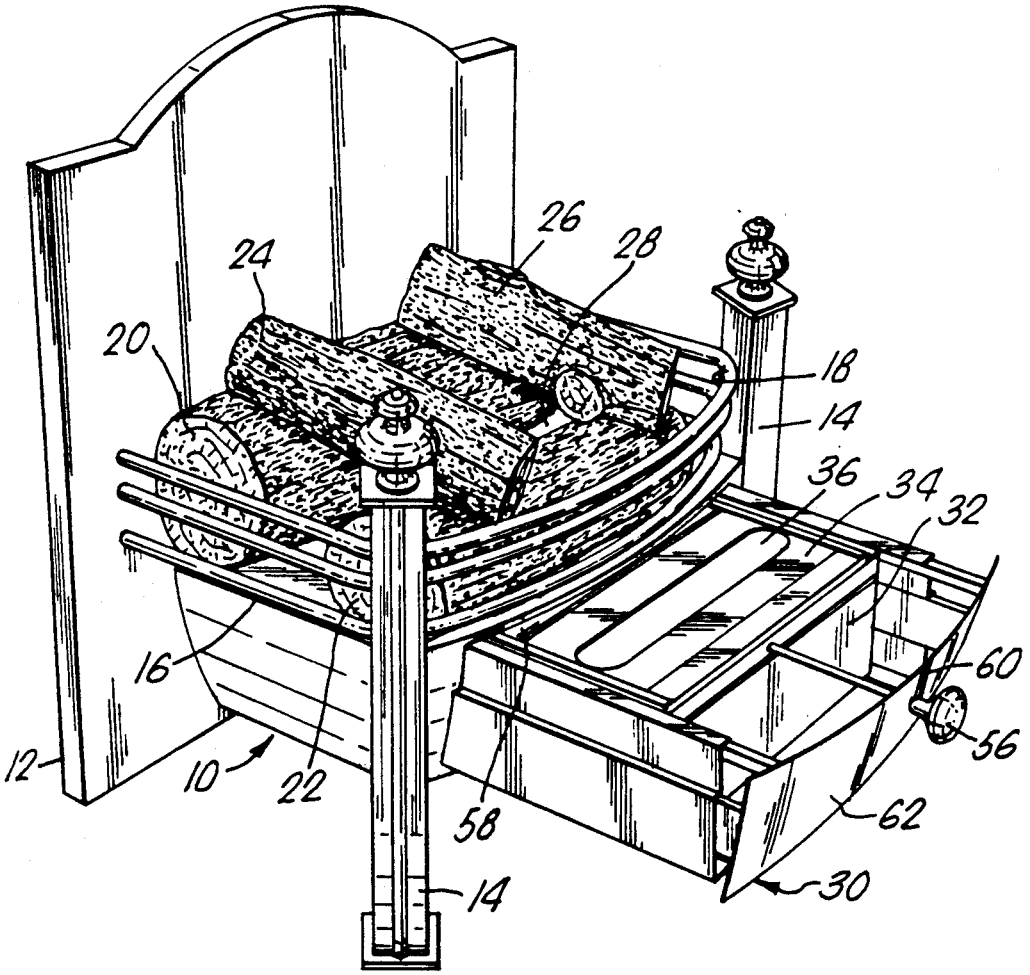
FIG. 1 is a perspective view of one embodiment of fire according to the invention, with the drawer shown in the open position.

Referring first to FIG. 1, the fire illustrated includes a frame 10 having a rear wall 12, front legs 14 and base 16 and surrounding bars 18. Mounted above the base 16 and within the bars 18 are four imitation logs. These include a first rear log 20 extending transversely of the fire, a similarly disposed front log 22 of smaller "diameter" than the log 20 and third and fourth logs 24, 26 extending from front to back and defining, with the logs 20, 22, a central opening 28 of generally rectangular shape.

FIG. 1 also illustrates, in an open position, a forwardly slidable drawer 30 in which may be positioned a generally rectangular elongate reservoir 32 of gel fuel, such as disclosed in U.S. Pat. No. 4,575,379. Positioned above the reservoir 32 is an aperture plate 34 having a central elongate aperture 36 which, when the drawer is in its closed position, will be positioned directly below the opening 28 between the logs 20–26. It will be appreciated that the base 16 will also have a further opening therein (not shown) in register with the aperture 36 and the opening 28 to allow the flames passing upwardly through the opening 36 to pass between the logs.

Figure 2:
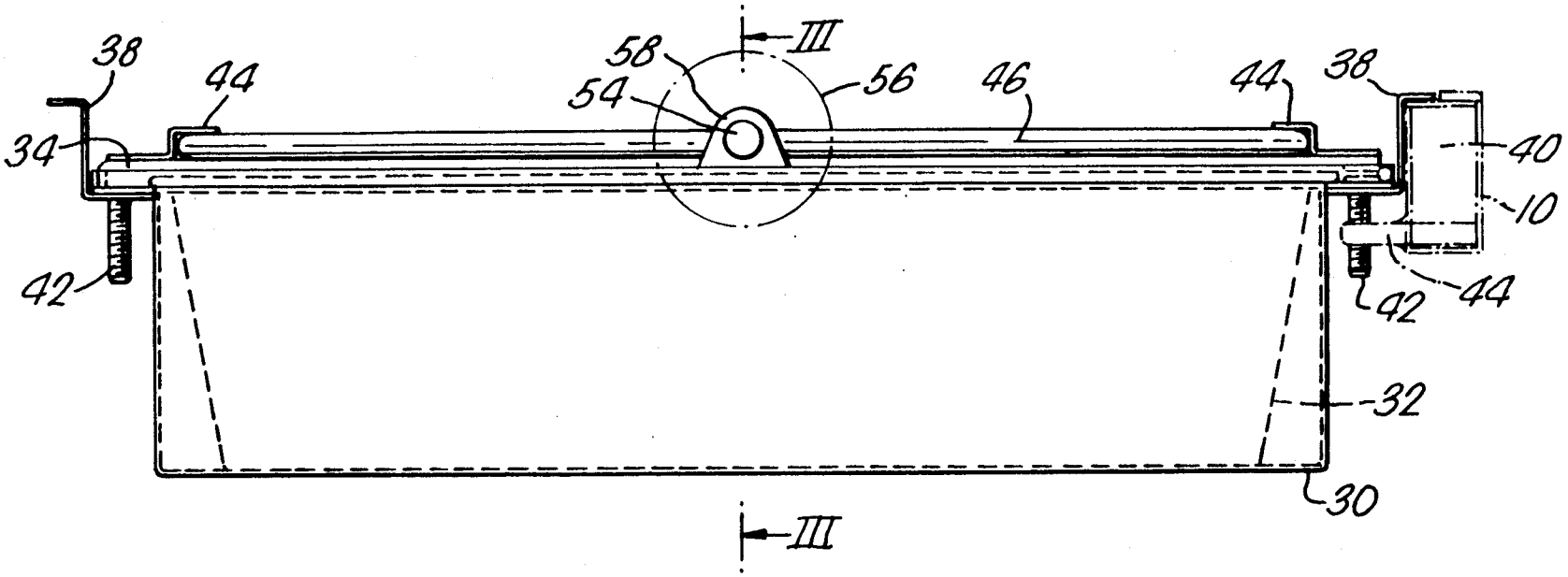
FIG. 2 is an enlarged front elevation showing the drawer and its slide arrangement of the fire of FIG. 1.

If reference is now made to FIG. 2, it will be seen that the drawer 30 has associated therewith, on each side, a double-angled rail 38 which is movable on rollers 40 (only the rollers 40 being shown on the right in FIG. 2 whereas there are further similar rollers on the left also) to allow the drawer to slide readily forwardly and rearwardly. Screws 42 are threaded into each rail 38 and engage stops 44 to prevent the drawer from being withdrawn fully. Mounted above each side of the aperture plate 34 are forwardly and rearwardly extending guide tracks 44 for guiding a generally U-shaped slider 46 having a front bar 48 and two side bars 50. Welded between the side bars 50 is a snuffer plate 52.

Extending forwardly from the centre of the crossbar 46 there is a control rod 54 having a front control knob 56, the rod 54 extending through an aperture in an upstanding lug 58 at the front of the aperture plate 34, the rod also extending through a vertical slot 60 in the front wall 62 of the drawer 30. A circlip 64 is mounted in the groove in the control rod. Thus, when the knob 56 is pulled forwardly, the snuffer plate 52 first moves forward and progressively closes the aperture 36 and then the circlip 64 acts as engagement means and abuts the front wall 62 so that the drawer can then be pulled outwardly.

Figure 3:
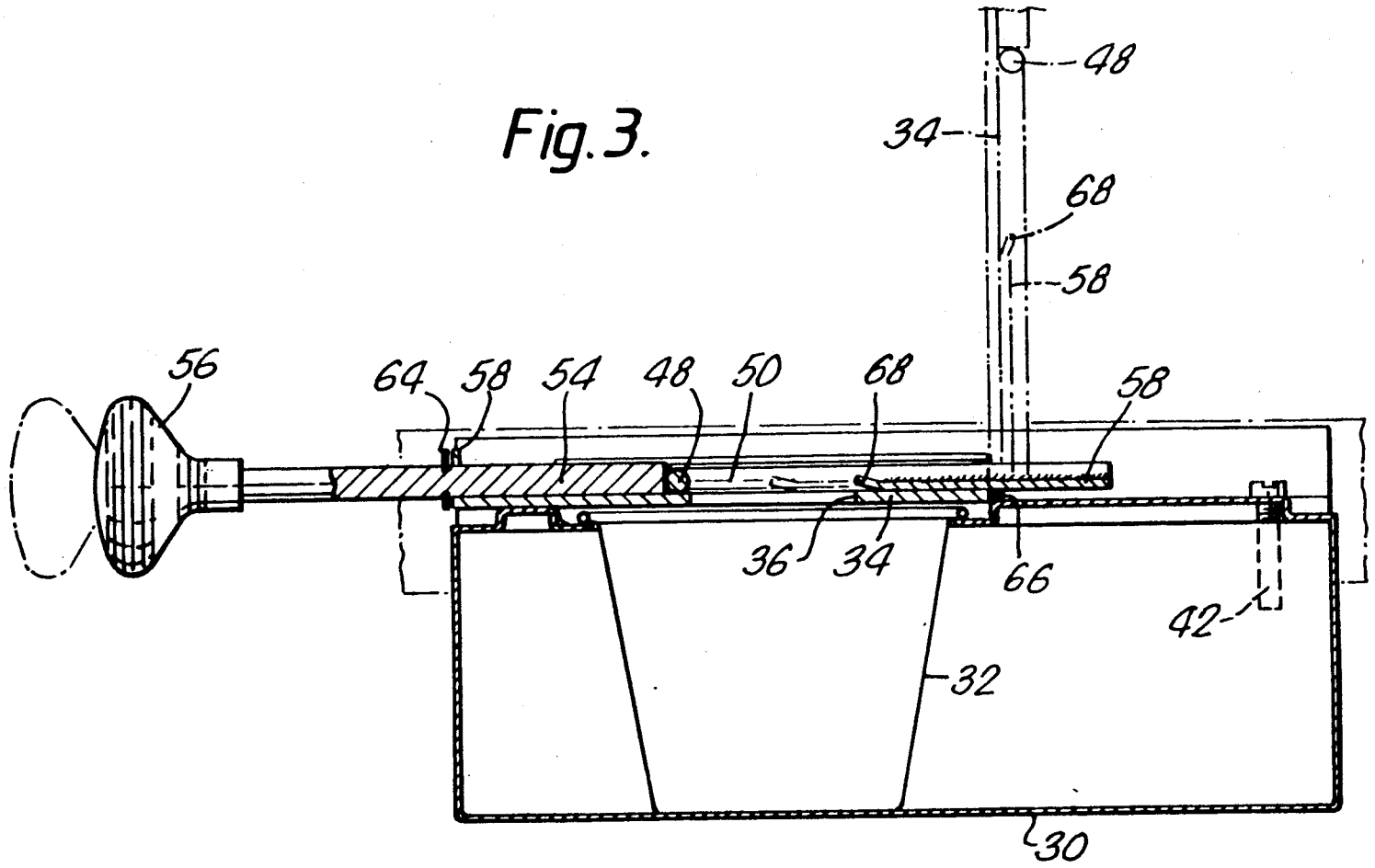
FIG. 3 is a section taken on the line III-III of FIG. 2.
Figure 4:
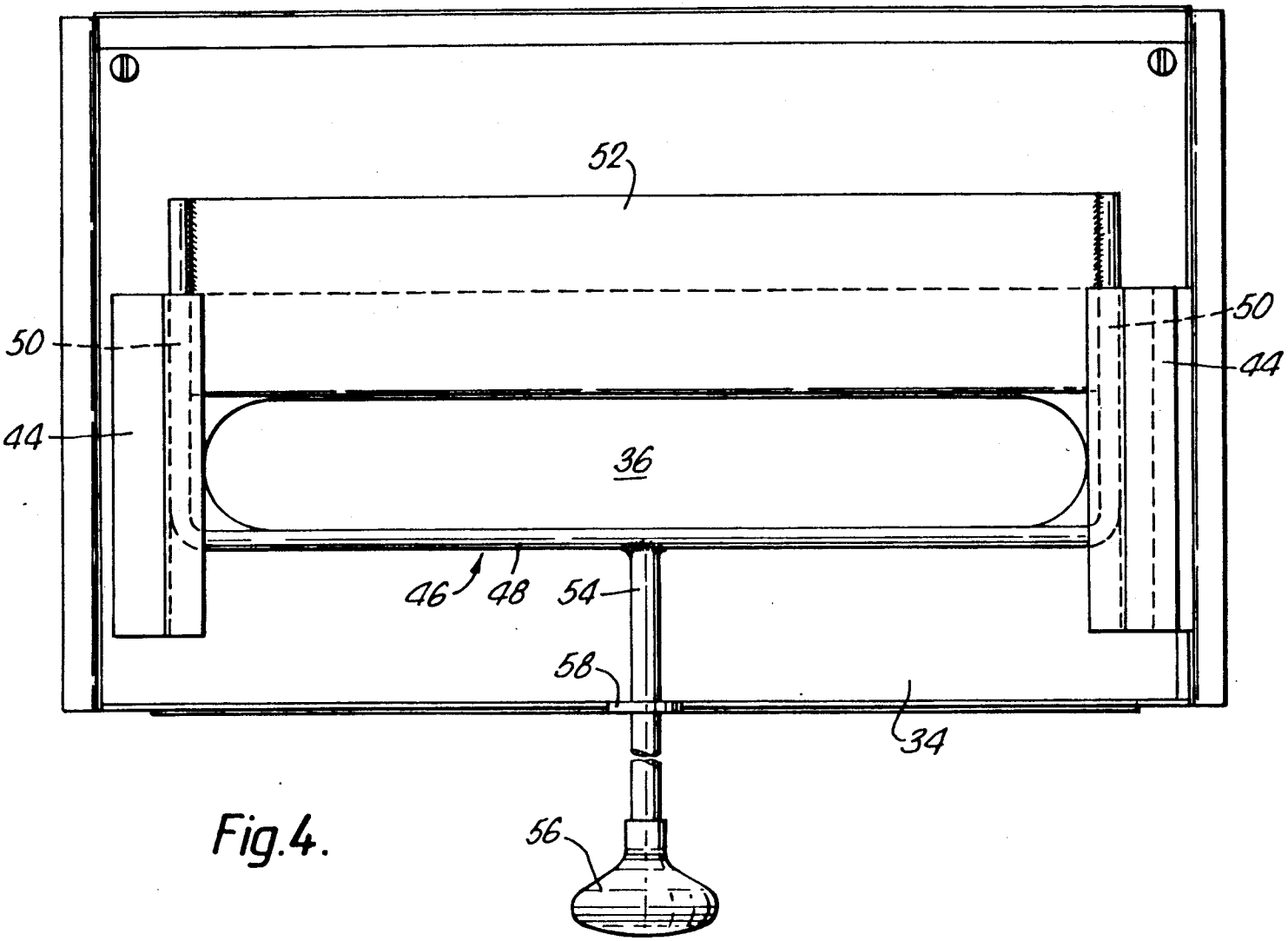
FIG. 4 is a plan view of the drawer, snuffer plate and aperture plate of the fire of FIG. 1.

If reference is made to FIG. 3, it can be seen that the aperture plate 34, and with it the snuffer plate 52, are pivoted at 66 to the drawer 30 about a transversely extending horizontal hinge line. When the control knob 56 has been pulled fully forwardly, that is just beyond the position illustrated in FIG. 3 to the position in which the knob itself is indicated in phantom, the knob and rod can be raised so that the aperture plate and snuffer plate can be raised to a substantially vertical position as illustrated schematically in phantom in FIG. 3.

It will be appreciated that in use of the fire, in order to load a reservoir 32 in position, one pulls the drawer fully forwardly by pulling the knob 56 and continued forward movement enables the knob to be raised as just described and a reservoir 32 can be positioned as illustrated. The control knob 56 and rod 54 are then pivoted downwardly and the knob pushed back until the knob engages the front 62 of the drawer 30. In this position, the aperture 36 is positioned above the opening in the top of the reservoir 32 and the snuffer plate is fully withdrawn to its rearmost position. One then applies a match through the aperture 36 and the fuel will light. The knob is then pushed rearwardly and the drawer and aperture plate move with it until the aperture 36 is positioned below the opening 28 and flames will play on the logs, giving adequate heat and giving a pleasing effect to the eye.

One can then control the amount of flame emanating by moving the knob forwardly so that the snuffer plate acts as a regulating means and partially closes the aperture 36 to the desired degree. When one wishes to extinguish the flame, the knob is pulled forwardly so that the snuffer plate completely blocks off the aperture 36. It will be seen that forward movement of the snuffer plate is facilitated by the very leading edge being slightly chamfered as shown at 68 in FIG. 3. When it is desired to replace the container, one again moves the control knob forwardly until the circlip 64 engages the front wall 62 of the drawer which is withdrawn and the procedure earlier described repeated.

What is claimed:

1. A log or coal effect fire comprising a frame, imitation logs or coal mounted on or supported by said frame, a drawer slidable or pivotable with respect to said frame from a first, operational position in which it is located below said imitation logs or coal, to a second, access position in which access can be gained to the interior of the drawer, an open topped fuel container for a gel or wax fuel mounted or mountable in the drawer at a location below the imitation logs or coal and an aperture means, having at least one aperture formed therein, said aperture means being positioned to overlie the open topped fuel container.

2. A fire as claimed in claim 1, wherein the aperture means includes a single aperture in the form of an elongate slot, the major axis of the slot extending transversely of the fire.

3. A fire as claimed in claim 2, including a snuffer means which comprises a snuffer plate.

4. A fire as claimed in claim 2, wherein the fuel container is substantially rectangular in shape and the elongate slot is shaped to overlie a major part of the open top of the container.

5. A fire as claimed in claim 1, wherein the container forms part of the drawer and is shaped to accommodate one or more separate fuel reservoirs.

6. A fire as claimed in claim 1, wherein the container itself is an interchangeable fuel reservoir.

7. A fire according to claim 1, wherein there are four imitation logs mounted on said frame said logs being, a first, rear log extending transversely of the fire, a second front log, of smaller cross section than the first log and extending substantially parallel thereto, and third and fourth logs extending in spaced substantially parallel relation to one another, substantially perpendicular to the first and second logs to define a generally rectangular opening therebetween.

8. A fire as claimed in claim 1, wherein said drawer is movable by forward sliding motion from its operational to its access position.

9. A fire as claimed in claim 1, and further comprising regulation means to regulate the size of the or each aperture in the aperture means.

10. A fire as claimed in claim 9, wherein said regulating means includes means to move said aperture means itself.

11. A fire as claimed in claim 1, and further comprising snuffer means, associated with said aperture plate and is movable to open and close the or each aperture in the aperture plate.

12. A fire as claimed in claim 11, wherein said snuffer means comprises a snuffer plate.

13. A fire as claimed in claim 11, and further comprising regulation means to regulate the size of the or each aperture in the aperture means and wherein said snuffer means forms all or part of said regulating means and is moveable progressively to open and close the or each aperture.

14. A fire according to claim 13, wherein the snuffer plate is slidable forwardly to close the or each aperture.

15. A fire as claimed in claim 11, wherein said drawer is movable by forward sliding motion from its operational to its access position and further comprising a control rod connected to said snuffer means to effect the movement thereof, said control rod having engagement means engageable with the drawer, whereby, when said control rod is operated in one direction, the snuffer means firstly closes the or each aperture in the aperture means and, when the or each aperture is fully closed, further operation in said one direction causes said drawer to move forwardly to its access position.

16. A fire as claimed in claim 15, wherein said aperture means and said snuffer means are movable to a position to enable said fuel container or reservoir container therein to be readily removed from said drawer and a fresh container or reservoir inserted.

17. A fire as claimed in claim 16, wherein said aperture means and said snuffer means are interconnected so that by operation of said control means additionally, after having been operated to bring said drawer to its access position, said aperture means and said snuffer means can be moved to a position, to give access to said fuel container.

18. A fire as claimed in claim 17, wherein said aperture means and snuffer means are each plates and the aperture plate and the snuffer plate are pivotal together about a transverse, horizontal hinge line, whereby said control rod can be raised, after being pulled fully forwardly, to pivot said plates to a generally vertical position, effective to give access to said fuel container.

* * * * *
* * * * *

UNITED STATES PATENT AND TRADEMARK OFFICE

CERTIFICATE OF CORRECTION

PATENT NO. : 5,026,271

DATED : June 25, 1991

INVENTOR(S) : ORLOV et al.

It is certified that error appears in the above-identified patent and that said Letters Patent is hereby corrected as shown below:

On the Title page, insert Assignee as follows:

Item [73] Assignee: Hunter Douglas International NV, Willemstad, Netherlands Antilles

Signed and Sealed this

Twenty-ninth Day of December, 1992

*Attest:*

DOUGLAS B. COMER

*Attesting Officer*

*Acting Commissioner of Patents and Trademarks*